United States Patent [19]

Ott

[11] Patent Number: 4,784,445

[45] Date of Patent: Nov. 15, 1988

[54] HEATED AND VENTILATED WORK STATION

[76] Inventor: Donald E. Ott, 17754 W. Spring Lake Rd., Spring Lake, Mich. 49456

[21] Appl. No.: 96,380

[22] Filed: Sep. 14, 1987

[51] Int. Cl.[4] ..... F24F 7/00

[52] U.S. Cl. ..... 312/236; 98/34.6

[58] Field of Search ..... 312/236, 209, 198

[56] References Cited

U.S. PATENT DOCUMENTS 4,378,727 4/1983 Doss ..... 98/33.1

*Primary Examiner*—Carl D. Friedman

[57] ABSTRACT

A modular office system for a factory or office, including partitioned work area units around a core or central container having fans to dissipate away heated air generated by computer equipment and to circulate other air located in the work area units.

4 Claims, 2 Drawing Sheets

HEATED AND VENTILATED WORK STATION

BACKGROUND OF THE INVENTION

1. Field of the Invention

This invention relates generally to office systems for use by office personnel. More specifically it relates to office work stations, such as each of which may accomodate one or several workers in a cluster. With the increasing use of computers in offices, modular work stations comprised of work spaces formed by means of partitions, have become commonplace in the office environment. Large room areas are now partially divided by partitions, rather than merely occupied by stereotyped rows of desks. However, problems have arisen from the use of dividing partitions. Typically they impede air movement causing extreme heat or cold in some areas, depending on the season. Accordingly, still more specifically this invention relates to thermal air circulation means within a modulator office system itself.

2. Prior Art

It is well known that numerous modular office systems have been designed in the past. While they all accomplish their intended task of providing ergonomic workspaces, they also have the undesirable characteristics of preventing adequate ventilation of the heat generated by the computer equipment and interfering with the circulation and distribution of heat or cold from the office's central heating and air conditioning systems. Thus there still remains a need at this time for an improved modular office system which overcomes the above indicated shortcomings.

SUMMARY OF THE INVENTION

Accordingly it is a principal object of the present invention to provide an effective factory or office modular work station which has a self-contained supplemental heating and ventilating system.

Another object is to provide an office modular system having self-contained indirect illumination means.

Still another object is to provide a self-contained supplemental heating and illumination system which is easily portable or movable, and thus usable as interior decorative art which functions to improve air temperature and its circulation.

Yet a further object is to provide a self-contained supplemental heating and ventilating system which is easily adaptable for a work station that may be either round, triangular, square, rectangular or any other configuration.

These and other objects will be readily evident upon a study of the following specification and the accompanying drawings.

BRIEF DESCRIPTION OF THE DRAWING FIGURES

DETAILED DESCRIPTION OF THE PREFERRED EMBODIMENT

Figure 1:
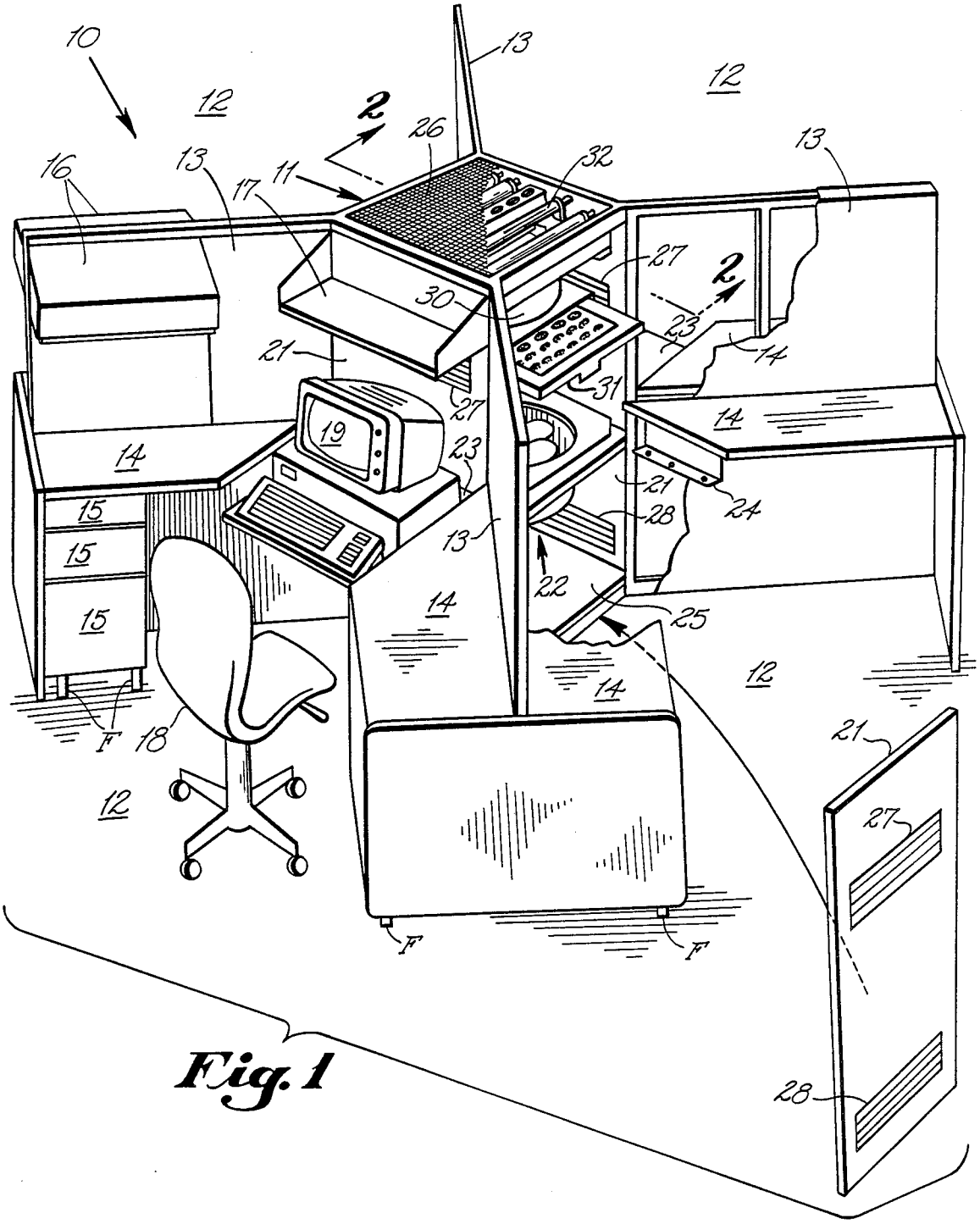
FIG. 1 is a perspective view of one embodiment of the invention for a four-unit modular office work station, shown partly disassembled.
Figure 2:
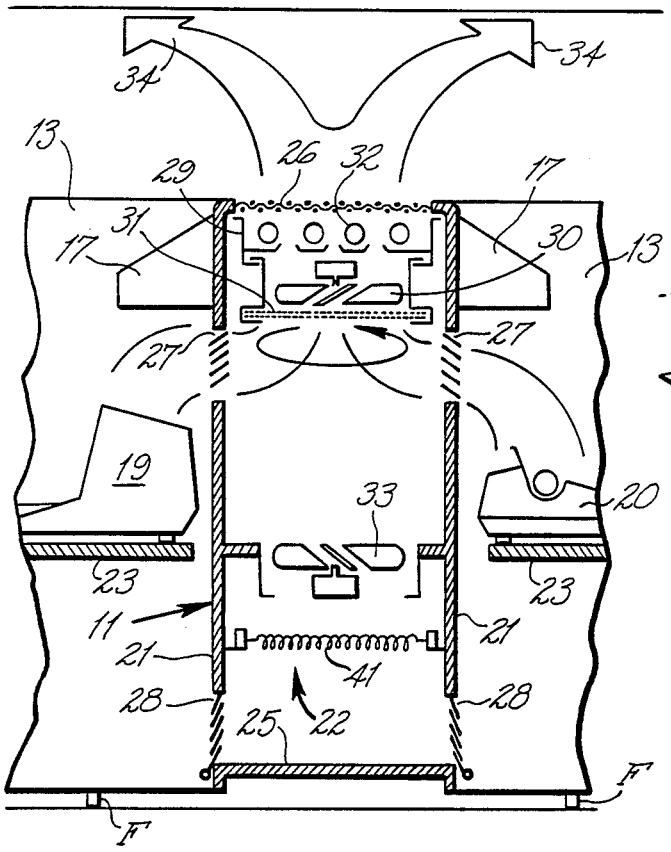
FIG. 2 is an enlarged, cross-sectional view taken on line 2—2 of FIG. 1, and illustrating the heat generated by a computer terminal being ventilated away from the computer operator.
Figure 3:
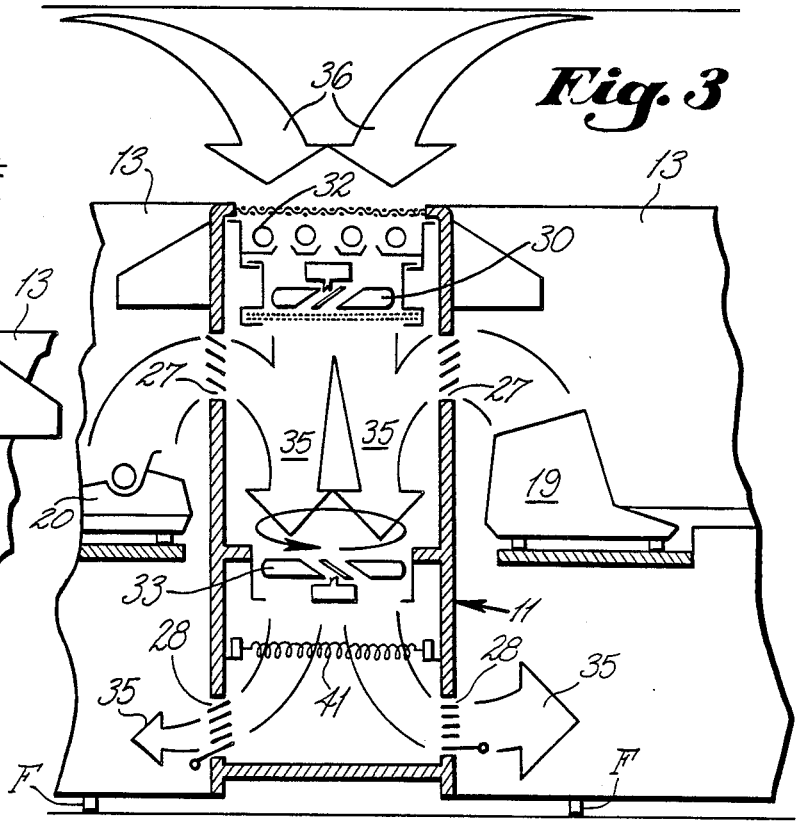
FIG. 3 is a similar cross-sectional view thereof, and illustrating the heat generated by a computer terminal being recirculated downward to the feet of the computer operator.

Referring now to the drawings in greater detail, and more particularly to FIGS. 1 to 3 thereof at this time, the reference numeral 10 represents a heated and ventilated work station according to the present invention wherein there is a core or central container 11 surrounded by a plurality of work area units 12 for dividing individual workers and their work; the units being formed by tall partitions 13 therebetween.

While the present invention is not limited to the specific design of work area units 12 shown in the drawing, it is presumed that each includes a desk or shift work surface 14 along the partitions with drawers 15. Overhead storage cabinets 16 or shelves 17 may be structured or hung from the partitions for convenient easy reach. A wheeled, swivel chair 18 in each unit allows a worker to turn or move to a work surface or to a computer terminal 19 or other electrically operated machine 20 located in the work area unit. The walls 13 have feet F on their underside for standing on a floor.

In the present invention, the core or central container 11 comprises a plurality of tall walls 21 surrounding a central space that contains a ventilating and heating system 22. Each vertical side edge of each wall 21 junctions with one end edge of a partition 13 radiating from the core or central container so that in each work unit it serves as an intermediate partition between the partitions 13 thereof. A shelf or disk 23, located between the work surfaces 14, and adjacent the outer side of wall 21 is mounted on brackets 24 for the purpose of supporting the computer terminal or office machine 20 thereupon. The shelf is removable so to take out wall 21 for access to the ventilating and heating system when required to be serviced. The design also includes a raised, solid bottom wall 25 closing its lower end and an open meshed screen 26 at its upper end.

The ventilating and heating system 22 includes an upper louvered opening 27 and a lower louvered opening 28 in each wall 21, the louvers whereof are tiltably adjustable upward or downward and fully opened or closed. A bracket assembly 29 is installed inside an upper end of the core or central container and located between the screen and the upper louvered openings. The bracket assembly supports an upper, reversible, two-directional fan 30 having a removable air filter 31 therebelow, while an incandescent or fluorescent lighting fixture 32 is thereabove immediately below the screen 26. The fixture gives indirect lighting upwardly over the work station. The system 22 also includes a lower, singledirectional fan installed inside a lower portion of the core or central container positioned between the upper and lower louvered openings. An electric heater 41 may be added below fan 33 so to further heat the recirculating air.

As shown in the drawings, the above-mentioned shelf 17 may be mounted on an outer side of the wall 21 and located immediately above the upper louvered opening so as to serve as a baffle or shield for guiding rising heated air generated from the computer terminal or office machine directly into the upper louvered opening. This shelf serves to conveniently store computer supplies.

In operative use, during times of warm weather, an operator in any unit of the station can activate the upper fan so as to ventilate away any of the heat generated by the computer or machine and drawing the heated air through upper louver opening 27 into the core or central container and then upwardly through the screen 26 and dissipate it toward the room ceiling, as shown by arrows 34, so to keep the air around the operator comfortable.

During cold weather, the lower fan may be activated instead, so to draw the heated air from the computers and machines downwardly in the core or central container and outwardly therefrom through the louvered openings 28 where it blows directly at the operator's feet for providing warmth thereto, as shown by arrows 35 in FIG. 3. If wished, a person may additionally activate the upper fan in a reverse direction so that warmer air adjacent a ceiling area is also downwardly drawn past the lighting fixture 32, being further heated thereby, and then also discharged out the lower louvered opening toward the operator's feet, as shown by arrows 36 in the same figure.

Figure 4:
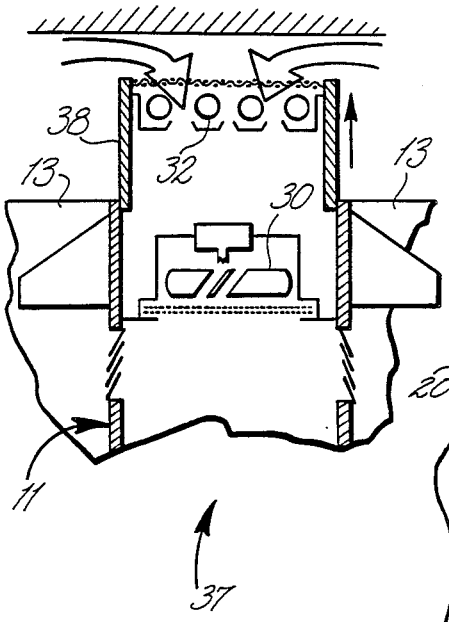
FIG. 4 is a fragmentary similar cross-sectional view showing a modified construction wherein the core or central container is upwardly telescopic toward a ceiling.

In a modified design 37 of the invention shown in FIG. 4, a telescopic upper section 38 carrying the lamp fixture is upwardly slidable on the unit so to reach warmer air yet closer to the ceiling.

Figure 5:
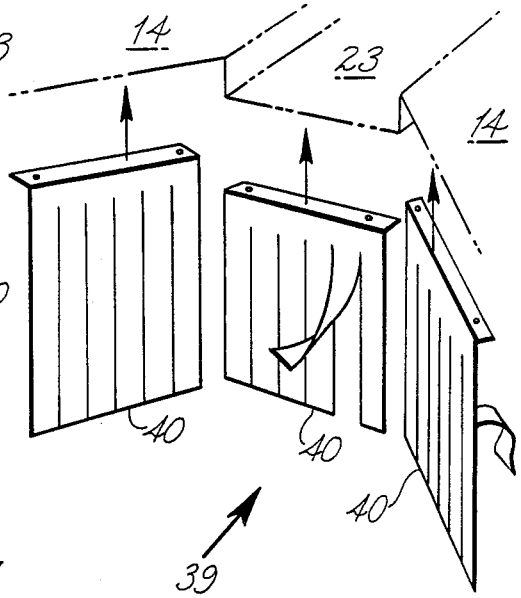
FIG. 5 is a perspective view of auxiliary overlapping flexible strip closures for retaining recirculated air at the operator's feet.

In another modified design 39 of the invention shown in FIG. 5, overlapping flexible strip closures are removably attachable along an edge of the work surface and shelf 23 to retain the circulated air around the operator's leg area.

While various changes may be made in the detail construction, it is understood that such changes will be within the spirit and scope of the present invention, as is defined by the appended claims.

What I claim as new, is:

1. A modular work station, comprising, in combination, an upright, hollow container around a central space and formed of a plurality of vertical walls, a plurality of vertical partitions radiating sidewardly outward from said container and defining work areas therebetween for persons and heat-generating equipment therewithin, a top end of said container being open, a lower end thereof being closed by a bottom wall, each said container vertical wall having an upper and a lower adjustable louvered vent opening therethrough for communication between each said work area and said container central space, said upper vent opening being adjacent said heat-generating equipment, for heated air therefrom to enter said container, said lower vent opening being adjacent a feet of said person; a two-directional fan, for either upwardly or downwardly air flow, being installed in said container between said upper vent opening and said container open top end, and a singledirectional fan for only downwardly air flow, being installed in said container between said upper and lower vent openings.

2. The combination as set forth in claim 1, wherein a lamp within an upper end of said container provides indirect lighting upwardly over said work station.

3. The combination as set forth in claim 2, wherein said container comprises a lower section and an upper section telescopically adjustable in total height, said upper section carrying said lamp and said two-directional fan.

4. The combination as set forth in claim 3, wherein a desk is in said work area, said equipment being thereupon, and a curtain of overlapping flexible strips depends from an edge of said desk enclosing an underdesk area receiving said person's feet thereinto from between said overlapping strips.

* * * * *